US012590534B2

(12) United States Patent
Wilson

(10) Patent No.: US 12,590,534 B2
(45) Date of Patent: Mar. 31, 2026

(54) SYSTEM AND METHOD FOR DETERMINING PLACEMENT OF A DOWNHOLE DEVICE

(71) Applicant: Scientific Drilling International, Inc., Houston, TX (US)

(72) Inventor: Joshua Wilson, Houston, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 40 days.

(21) Appl. No.: 18/785,995

(22) Filed: Jul. 26, 2024

(65) Prior Publication Data

US 2025/0101860 A1 Mar. 27, 2025

Related U.S. Application Data

(60) Provisional application No. 63/539,984, filed on Sep. 22, 2023.

(51) Int. Cl.

| | |
|---|---|
| ***E21B 47/09*** | (2012.01) |
| ***E21B 47/024*** | (2006.01) |
| ***E21B 47/08*** | (2012.01) |

(52) U.S. Cl.

CPC ..... *E21B 47/09* (2013.01); *E21B 47/024* (2013.01); *E21B 47/08* (2013.01)

(58) Field of Classification Search

CPC ..... E21B 47/09; E21B 47/024; E21B 47/08; G06F 30/20

See application file for complete search history.

(56) References Cited

U.S. PATENT DOCUMENTS

| | | | | |
|---|---|---|---|---|
| 10,316,639 | B2 | 6/2019 | Bang et al. | |
| 10,329,896 | B2 | 6/2019 | Bang et al. | |
| 2019/0114553 | A1* | 4/2019 | Gharib | E21B 47/022 |
| 2024/0044238 | A1* | 2/2024 | Wolniak | G06F 30/20 |

OTHER PUBLICATIONS

Billger, Dag and Mcleod, Duncan; "A technical note on dogleg severity"; Coring Magazine #18; ISSN 2367-847X; Issue 18, Jan. 2022; Coring Media Ltd., Sofia, Bulgaria (3 pages).

Heisig, G., et al.; "Continuous Borehole Curvature Estimates While Drilling Based on Downhole Bending Moment Measurements"; SPE-90794; Sep. 26-29, 2004; Society of Petroleum Engineers Inc.; Houston, TX (14 pages).

* cited by examiner

*Primary Examiner* — Dany E Akakpo

(74) *Attorney, Agent, or Firm* — EWING & JONES, PLLC

(57) ABSTRACT

Data from a well survey includes information on wellbore depth in combination with inclination and azimuth or bending moment taken at measured depth intervals with sufficient short spans to detect micro doglegs in a wellbore over lengths less than, for example, thirty meters. A conversion quantifies micro dogleg severity detected for expression in units of degrees per standardized set length. The converted quantification may also be used in circle-based equations to determine maximum tool length or width for passing tools through the wellbore due to the micro doglegs. Disposing the tool in the wellbore may occur at a location identified to accommodate the tool.

10 Claims, 3 Drawing Sheets

SYSTEM AND METHOD FOR DETERMINING PLACEMENT OF A DOWNHOLE DEVICE

TECHNICAL FIELD/FIELD OF THE DISCLOSURE

This application is a nonprovisional application which claims priority from U.S. provisional application No. 63/539,984, filed Sep. 22, 2023, which is incorporated by reference herein in its entirety.

TECHNICAL FIELD/FIELD OF THE DISCLOSURE

The present disclosure relates generally to determining a location in a wellbore for placing a downhole device.

BACKGROUND OF THE DISCLOSURE

Dogleg severity is a measure of the change in direction of a drilled wellbore over a certain length. The more severe a dogleg, the greater are the potential problems with moving tools through that dogleg. For instance, when placing a pump downhole, it is useful to know whether the length and diameter of the pump are sufficiently small to allow the pump to pass through the dogleg. The present disclosure describes novel methods not previously employed using micro dogleg severity to determine where such downhole tools may be placed downhole. Use of traditional dogleg severity methods are ineffective for determining proper placement of a downhole tool as traditional dogleg severity methods measure doglegs over downhole distances that are insufficiently exact to find doglegs that would impair tool placement.

SUMMARY

The present disclosure provides for methods and apparatus for placing a tool in a well having micro doglegs.

For one embodiment, a method of selecting placement for a tool in a well having micro doglegs includes obtaining survey data from the well and determining dogleg angles for measured depth intervals indicative of curvatures along less than 8 meters of the well by using the survey data. Converting the dogleg angles provides micro dogleg severity (MDLS) in degrees per set length, which is greater than the measured depth intervals. The method further includes determining maximum dimensions of the tool allowed based on restrictions caused by the micro doglegs along the length of the well using the MDLS and generating either a table with the maximum dimensions of the tool listed with depths in the well or a graph plotting the maximum dimensions of the tool versus depth in the well.

According to one embodiment, a method of selecting placement for a tool in a well having micro doglegs includes running a survey device into the well to provide survey data and determining a dogleg angle for a measured depth interval along a length of the well from the survey data. Converting the dogleg angle provides micro dogleg severity (MDLS) in degrees per set length greater than the measured depth interval. Calculating a maximum dimension of the tool uses a function of the MDLS and either Equation 5 or 6.

In one embodiment, an apparatus for selecting placement of a tool in a well having micro doglegs includes a processor with memory to perform steps that obtain survey data from the well and determine dogleg angles for measured depth intervals indicative of curvatures along less than 8 meters of the well by using the survey data. The processor with memory further converts the dogleg angles to provide micro dogleg severity (MDLS) in degrees per set length, which is greater than the measured depth intervals. The steps performed also determine maximum dimensions of the tool allowed based on restrictions caused by the micro doglegs along the length of the well using the MDLS and generate either a table with the maximum dimensions of the tool listed with depths in the well or a graph plotting the maximum dimensions of the tool versus depth in the well.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
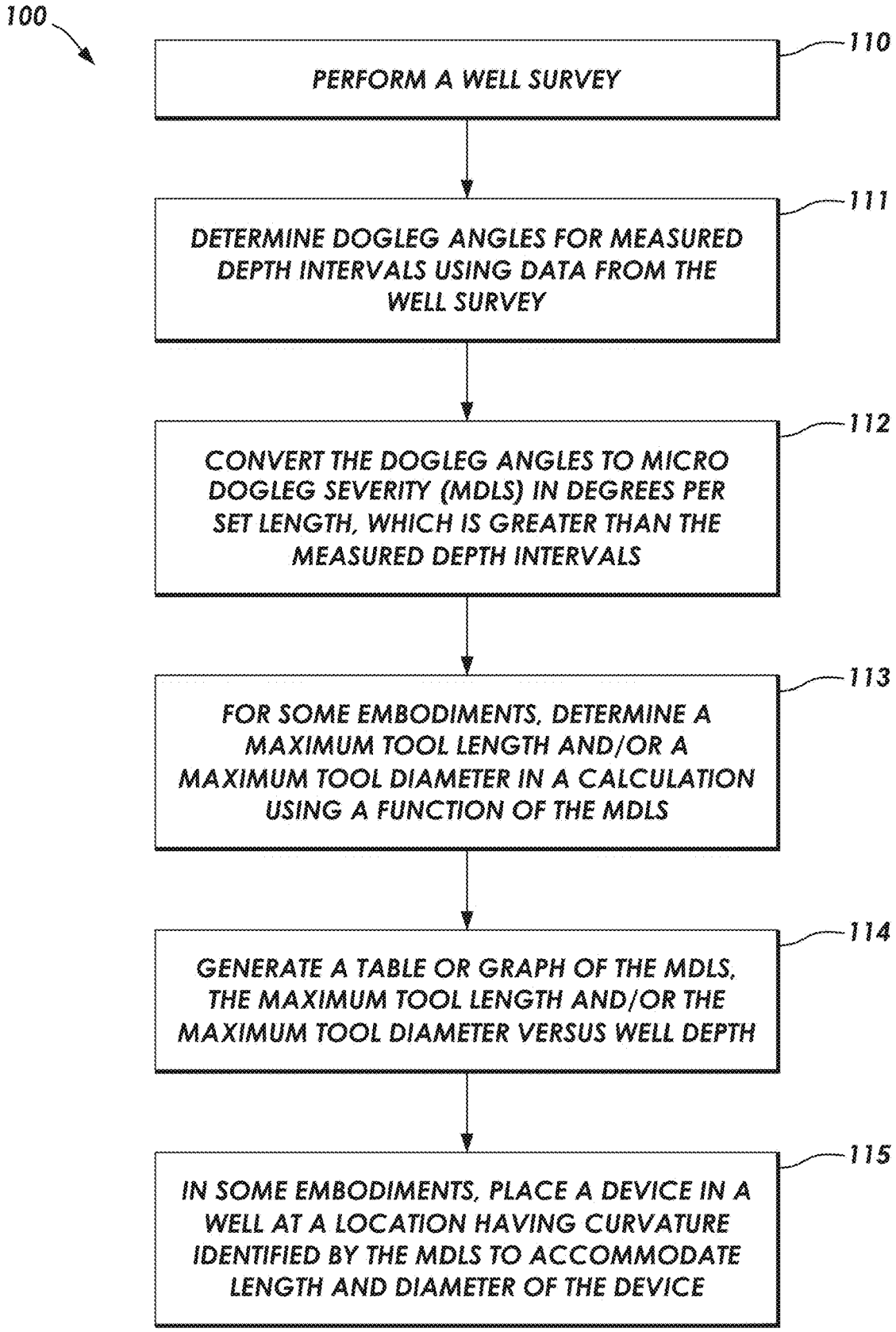
FIG. 1 is a flow chart depicting a method consistent with certain embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts Micro DogLeg Severity (MDLS) placement method 100. MDLS placement method 100 includes performing well survey 110. In performing well survey 110, a well surveying instrument is traversed through drilled wellbore, such as on a wireline, or during drilling, for instance, as part of a Measurement While Drilling (MWD) apparatus. The surveying instrument may be any device capable of gathering information sufficient to determine bending moment or well azimuth and inclination at a measured depth of the wellbore at survey stations along the wellbore. Examples of such surveying instruments include gyroscopic instruments and magnetic instruments in conjunction with accelerometers.

In some embodiments, the information gathered may be at survey stations at equal intervals along the wellbore. In other embodiments, the survey stations are not at equal intervals along the wellbore. With continuous recording by the surveying instrument to create high-density surveys, the survey stations may approach being unconfined in actual number and location. The surveying instrument may measure three-dimensional coordinates at each survey station from which inclination, azimuth and wellbore depth are determined. In some embodiments, the inclination and azimuth data used at each survey station comes from being derived from a pseudo-survey of the continuous recording rather than an actual direct measurement made by sensing right at the survey station.

Figure 2:
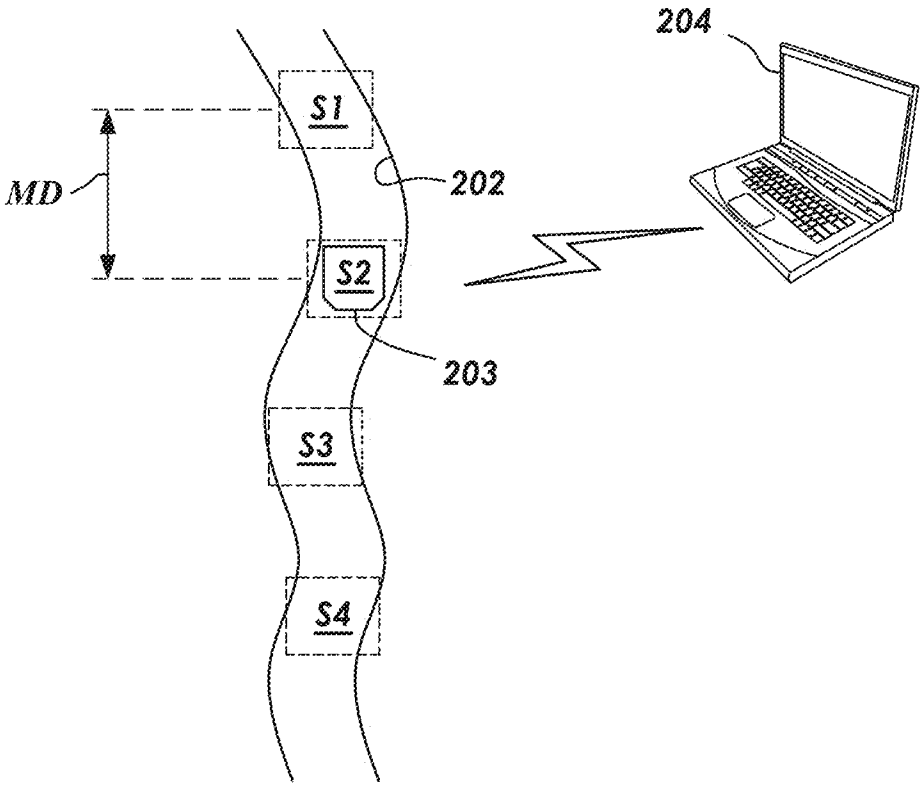
FIG. 2 is a schematic side view of a wellbore with curvatures and four exemplary survey stations to generate data obtained and used by a computer, according to one embodiment.

FIG. 2 depicts physical aspects of performing well survey 110 in FIG. 1 with a wellbore 202 including exemplary first, second, third and fourth survey stations S1, S2, S3, S4 where azimuth and inclination data is generated, such as by a survey device 203 at second survey station S2. In some embodiments, a measured depth (MD) interval between the survey stations (e.g., actual length separating the first and second stations S1, S2 along the wellbore 202) provides ability to detect relative short doglegs by having a spacing that is less than 30 meters, less than 8 meters, less than 5 meters, less than 1 meter, less than 0.5 meters or between 0.25 meters and 3 meters. The shortness of the dogleg being detected thus facilitates tool placing since tool passage may not be accurately determined based on only identifying relative larger doglegs in the wellbore 202. For some embodiments, the MD interval selected approximates or matches length of the tool desired to be placed in the wellbore 202. The MD intervals along the wellbore 202 may also be of equal length or vary in length from one another.

The survey stations S1, S2, S3, S4 may correspond to measured intervals along the wellbore 202 where the data is generated by the survey device 203 or result from the survey device 203 having a sampling rate based on travel speed of the survey device 203 through the wellbore 202 to provide the data at each of the survey stations S1, S2, S3, S4. While shown as only four of the survey stations S1, S2, S3, S4 for explanation purposes, the wellbore 202 includes many more survey stations along the length of the wellbore 202, which may extend over 1500 meters (e.g., thereby including 50 to over 3000 survey stations) or over 3000 meters in many instances. Moreover, the survey device 203 may generate the data at additional stations between each of the survey stations S1, S2, S3, S4 since the survey stations S1, S2, S3, S4 are depicted only for illustration purposes to show the MD interval, which is used by a computer 204 (having a processor, physical memory and user interface, such as a display or a printer), in accordance with further steps of MDLS placement method 100 shown in FIG. 1 and further described below.

In dogleg angle step 111 of MDLS placement method 100 in FIG. 1, the processor obtains the azimuth and inclination data and determines an initial dogleg angle using the azimuth and inclination data from the first survey station S1 at a start of an initial MD interval and the second survey station S2 at an end of the initial MD interval. Some embodiments may remove noise in the azimuth and inclination data with the processor using a smoothing algorithm, such as a moving average or sovitsky-golay filter, prior to determining the initial dogleg angle. The processor may also convert the information gathered at the survey stations S1, S2, S3, S4 to north, east and vertical coordinates in some embodiments.

Exemplary calculations used to determine the dogleg angle ($\beta_{DL}$) include the following:

$$\beta_{DL} = a\cos[\sin\omega_1\sin\omega_2\cos(\alpha_1-\alpha_2)+\cos\omega_1\cos\omega_2]; \text{ and} \quad \text{[Equation 1]}$$

$$\beta_{DL} = 2a\sin^2\left\{\sqrt{\sin^2\left(\frac{\omega_2-\omega_1}{2}\right)+\sin\omega_1\sin\omega_2\sin^2\left(\frac{\alpha_2-\alpha_1}{2}\right)}\right\}, \quad \text{[Equation 2]}$$

where ($\alpha_1$) is a first azimuth at the first survey station S1, ($\omega_1$) is a first inclination at the first survey station S1, ($\alpha_2$) is a second azimuth the second survey station S2 and ($\omega_2$) is a second inclination at the second survey station S2. The processor then repeats the calculations in dogleg angle step 111 for additional MD intervals continuing along a length of the wellbore 202 at a repetition interval, which in some embodiments is less than 25 meters, less than 15 meters, or less than 5 meters using additional survey stations (e.g., the second and third survey stations S2, S3 and so forth) along the length of the wellbore to provide additional dogleg angles. As used herein, the repetition interval refers to distance between respective starting survey stations of sequential MD intervals in the wellbore and is therefore equal to the MD interval if no overlap between subsequent MD intervals and a shared survey station is used as ending and starting stations respectively for previous and subsequent MD intervals. By way of example, the first and third survey stations S1, S3 may be spaced to provide the MD interval of desired spacing as described above and the subsequent MD interval may use the second and fourth survey stations S2, S4 also with desired spacing for the MD interval. As another example without the MD intervals overlapping, MD intervals may use the first and second survey stations S1, S2 for the initial MD interval and then use the third and fourth survey stations S3, S4 as the subsequent MD interval.

For embodiments using a bending moment analysis in dogleg angle step 111, the survey device 203 may include a strain sensor to measure bending moment of the survey device 203 during performing well survey 110. A bottom hole assembly (BHA) with the strain sensor may provide the survey device 203 for MWD. Curvature of the wellbore 202 corresponds with curvature of the survey device 203 measuring the bending moment thereby enabling determination of the dogleg angle with the bending moment analysis as an alternate option to coordinate based analysis using the inclination and azimuth data. Dimensions of the survey device 203 along with where the strain sensor is disposed on the survey device 203 define the MD interval for the bending moment analysis. Like continuous recording of the inclination and azimuth data, strain data obtained from the survey device 203 may be continuous or result from the survey device 203 having a sampling rate based on travel speed of the survey device 203 through the wellbore 202. The strain data may thus provide the MD intervals and the repetition intervals of same lengths as described above with the coordinate based analysis using the survey stations S1, S2, S3, S4 even though the bending moment analysis uses single measurement locations to determine each of the dogleg angles without relying on comparison between two locations as with the coordinate based analysis.

In dogleg angle step 111 using the bending moment analysis, the processor obtains the strain data from the survey device 203 and in some embodiments calculates the dogleg angle ($\beta_{DL}$) as:

$$\beta_{DL} = \frac{M}{EI} * L_{\beta_{DL}}, \quad \text{[Equation 3]}$$

where (M) is the bending moment measured by the survey device 203, (E) is the modulus of elasticity of the survey device 203, (I) is the moment of inertia of the survey device 203 cross section and ($L_{\beta_{DL}}$) is a length corresponding to the dogleg angle calculated (i.e., ($L_{\beta_{DL}}$) for Equation 3 is defined by distance between measurements taken by the survey device 203). If the bending moment is in units of Nm and the moment of inertia is in units of $Nm^2$, multiplying by 180°/π converts the dogleg angle ($\beta_{DL}$) from units of radians per meter to degrees per meter. Equation 3 thus results in the dogleg angles for the MD intervals obtained using the bending moment analysis expressed as a unitary length.

MDLS placement method 100 then includes conversion step 112 to facilitate in making the dogleg angles determined from dogleg angle step 111 more relevant to users and better suited for potential subsequent steps in MDLS placement method 100. The MD intervals, while being of desired shortness, result in the dogleg angles not being normalized to common standards due to the shortness and/or any differences among the MD intervals for each of the dogleg angles, unique wells and/or varied user interests in defining the MD intervals. For some embodiments, the processor in conversion step 112 calculates MDLS number (MDLS) as:

$$MDLS = \frac{\beta_{DL}}{L_{\beta_{DL}}} * L_{MDLS}, \quad \text{[Equation 4]}$$

where ($\beta_{DL}$) is the dogleg angle determined by dogleg angle step 111, ($L_{\beta_{DL}}$) is a length corresponding to the dogleg angle calculated (i.e., ($L_{\beta_{DL}}$) is the actual length in which starting and ending survey stations are separated from one another for the MD interval corresponding to the dogleg angle calculated using Equation 1 or 2 or is defined by distance between measurements taken by the survey device 203 when the dogleg angle is calculated using Equation 3) and ($L_{MDLS}$) is the distance factor necessary to provide the MDLS number in degrees per desired unit of set length. For example, the MD interval may be 1.3 meters and the distance factor may be 30.48 meters in order to provide the MDLS number in degrees per 100 feet (or 30.48 meters). In some embodiments, the MD interval actual length is less than 5 meters, and the set length is greater than 10 meters.

Some embodiments then use the MDLS number in tool analysis step 113 of MDLS placement method 100 to determine at least one of maximum tool diameters (or otherwise width dimension for non-circular tool cross-sections) and maximum tool lengths suitable for placement in locations corresponding to specific MD intervals along the wellbore given identified micro doglegs of the wellbore at, and before, the locations. Since the MDLS number is standardized in conversion step 112 and is expressed in common geometric dimensions including degrees applicable to circles, a function of the MDLS number enables approximating wellbore curvature at a particular MD interval with circles and radiuses from a common origin and making derivations based on such circles and chord lengths of circles to calculate an estimate of the maximum tool diameters/lengths. The estimations result in conservative dimensions and hence beneficially provide tolerance for the tool in the wellbore.

Figure 3:
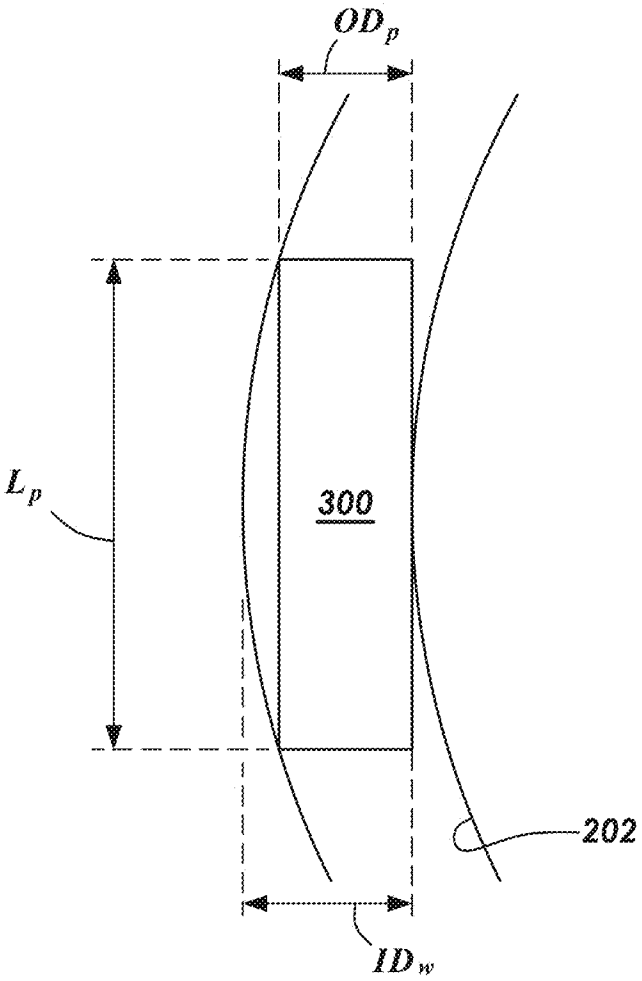
FIG. 3 is a schematic side view of a pump disposed in a dogleg of the wellbore with dimensions identified for calculations based on micro dogleg severity determinations, in accordance with one embodiment.

FIG. 3 shows a pump 300 as the tool disposed in the wellbore 202 with relevant dimensions identified for derived equations used in tool analysis step 113 of MDLS placement method 100, in accordance with one embodiment. If length of the pump 300 ($L_p$) is known, the processor can determine a maximum outer diameter of the pump 300 ($OD_p$) using:

$$OD_P = \sqrt{\left(\frac{1}{\kappa} + \frac{ID_w}{2}\right)^2 - \left(\frac{L_p}{2}\right)^2} - \left(\frac{1}{\kappa}\right) + \frac{ID_w}{2}, \quad \text{[Equation 5]}$$

where (κ) is a function of the MDLS number and ($ID_w$) is inner diameter of the wellbore 202. Length of the pump 300 often corresponds to number of pump stages. Determining max pump length, or thus max number of pump stages, may be determined by the processor using:

$$L_p = 2\sqrt{\left(\frac{1}{\kappa} + \frac{ID_w}{2}\right)^2 - \left(\frac{1}{\kappa} - \frac{ID_w}{2} + OD_p\right)^2}, \quad \text{[Equation 6]}$$

where (κ) is a function of the MDLS number, ($ID_w$) is inner diameter of the wellbore 202 and outer diameter of the pump 300 ($OD_p$) is a known dimension. In Equations 4 or 5, the inner diameter of the wellbore dimension may come from knowing size of the bit or casing and hence wellbore or, in some embodiments, be part of the information obtained using caliper data or other sensing to measure wellbore/tubing inner diameter variations in performing well survey 110.

Output step 114 included in some embodiments of MDLS placement method 100 occurs when the processor generates a report to the user, such as via the display or tangible printout. The report may include a table with the MDLS number listed with depths in the wellbore or a graph plotting the MDLS number versus depth in the wellbore, for some embodiments. The maximum outer diameter of the tool or maximum length of the tool as determined by tool analysis step 113 may be plotted relative to depth in the wellbore in a graph or table, in other embodiments of the report.

Figure 4:
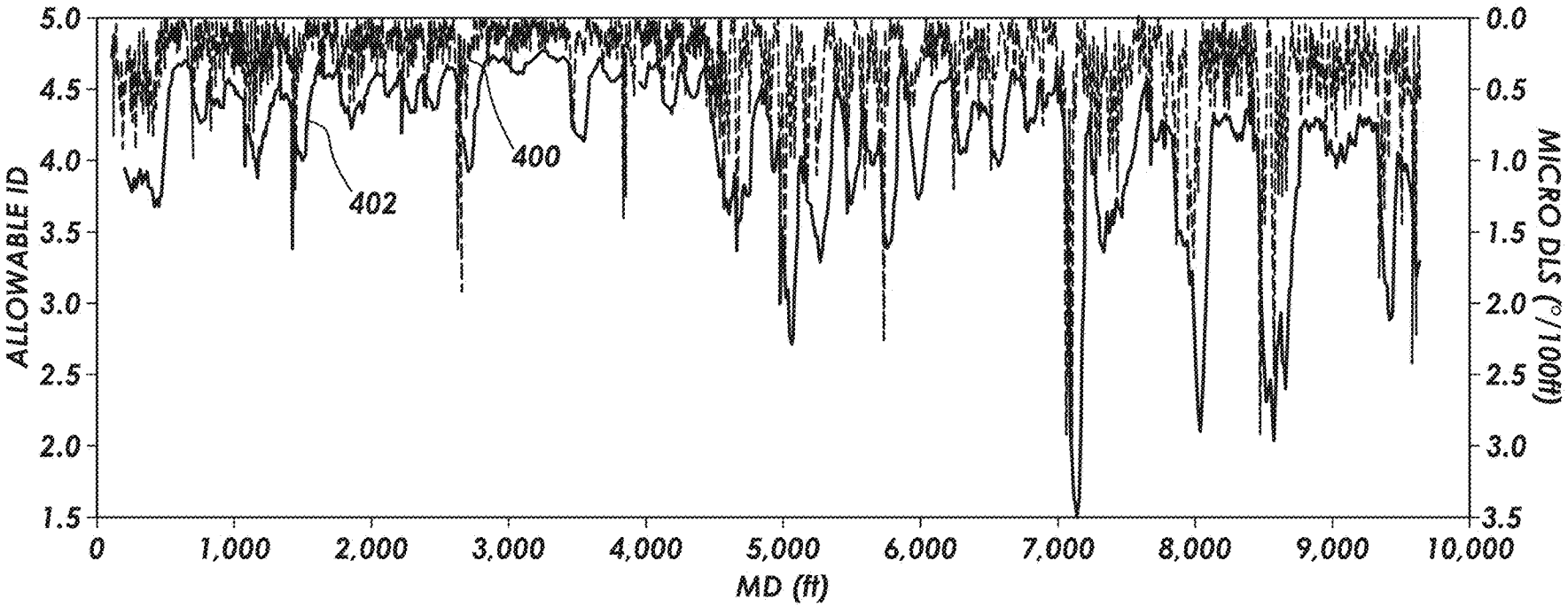
FIG. 4 is a plot of micro dogleg severity and maximum outer diameter of a tool both plotted versus well depth, pursuant to one embodiment.

FIG. 4 illustrates an exemplary plot for output step 114. The plot includes the MDLS number as MDLS line 400 and the maximum outer diameter of the pump as allowable dimension line 402 both plotted versus well depth. By way of example, the user can visualize and know from the plot that the pump based on allowable dimension line 402 must be less than 1.5 inches to ensure passage just past 7000 feet in the wellbore.

Tool placement step 115 of MDLS placement method 100 optionally places a device, such as the pump 300 shown in FIG. 3, at a location in the wellbore 202 having micro doglegs identified, such as via output step 114, in MDLS placement method 100 that is less than a max curvature threshold of the pump 300 due to length and diameter of the pump 300. As indicated with regards to FIG. 4 and as an example applying tool placement step 115, the user may desire to place the pump 300 having a diameter of 2.0 inches as deep as possible in the wellbore 202 and hence selects the location for placement then at 7000 feet to stay within areas of the wellbore 202 that are less than the max curvature threshold of the pump 300.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method of placing a tool in a well having micro doglegs, comprising:

obtaining survey data from the well;

determining dogleg angles for measured depth intervals indicative of curvatures along less than 8 meters of the well by using the survey data;

converting the dogleg angles to micro dogleg severity (MDLS) in degrees per set length, wherein the set length is greater than the measured depth intervals;

determining maximum dimensions of the tool allowed based on restrictions caused by the micro doglegs along the well using the MDLS;

generating one of a table with the maximum dimensions of the tool listed with depths in the well and a graph plotting the maximum dimensions of the tool versus depth in the well; and placing the tool in the well at a location where the maximum dimensions of the tool are identified in the generating step that enable the running of the tool to the location due to length and diameter of the tool.

2. The method of claim 1, wherein the measured depth intervals are indicative of curvatures along less than 5 meters of the well, and the set length in the converting to the MDLS is greater than 10 meters.

3. The method of claim 1, wherein the determining the maximum dimension of the tool includes determining a maximum outer diameter of the tool ($OD_t$) using a function of the MDLS to provide ($\kappa$) in equation $$OD_t = \sqrt{\left(\frac{1}{\kappa} + \frac{ID_w}{2}\right)^2 - \left(\frac{L_t}{2}\right)^2} - \left(\frac{1}{\kappa}\right) + \frac{ID_w}{2},$$

for given inner diameter of the well ($ID_w$) and length of the tool ($L_t$).

4. The method of claim 1, wherein the determining the maximum dimension of the tool includes determining a maximum length of the tool ($L_t$) using a function of the MDLS to provide ($\kappa$) in $$L_t = 2\sqrt{\left(\frac{1}{\kappa} + \frac{ID_w}{2}\right)^2 - \left(\frac{1}{\kappa} - \frac{ID_w}{2} + OD_t\right)^2},$$

for given inner diameter of the well ($ID_w$) and outer diameter of the tool ($OD_t$).

5. The method of claim 1, further comprising removing noise in the survey data using a smoothing algorithm.

6. The method of claim 1, wherein the generating outputs the graph.

7. The method of claim 1, wherein the determining of the dogleg angles uses strain sensor measurements for a bending moment analysis.

8. The method of claim 1, wherein the determining of the dogleg angles ($\beta_{DL}$) uses a first azimuth ($\alpha_1$) and a first inclination ($\omega_1$) at a first survey station and a second azimuth ($\alpha_2$) and a second inclination ($\omega_2$) at a second survey station and an equation selected from:

$$\beta_{DL} = a\cos[\sin\omega_1 \sin\omega_2 \cos(\alpha_1 - \alpha_2) + \cos\omega_1 \cos\omega_2]; \text{ and}$$

$$\beta_{DL} = 2a\sin^2\left\{\sqrt{\sin^2\left(\frac{\omega_2 - \omega_1}{2}\right) + \sin\omega_1 \sin\omega_2 \sin^2\left(\frac{\alpha_2 - \alpha_1}{2}\right)}\right\}.$$

9. A method of placing a tool in a well having micro doglegs, comprising:

running a survey device into the well to provide survey data;

determining a dogleg angle for a measured depth interval along the well from the survey data;

converting the dogleg angle to micro dogleg severity (MDLS) in degrees per set length greater than the measured depth interval; and calculating a maximum dimension of the tool using a function of the MDLS to provide ($\kappa$) in an equation selected from:

$$OD_t = \sqrt{\left(\frac{1}{\kappa} + \frac{ID_w}{2}\right)^2 - \left(\frac{L_t}{2}\right)^2} - \left(\frac{1}{\kappa}\right) + \frac{ID_w}{2},$$

to provide a maximum outer diameter of the tool ($OD_t$) for given values of inner diameter of the well ($ID_w$) and maximum length of the tool ($L_t$);

$$L_t = 2\sqrt{\left(\frac{1}{\kappa} + \frac{ID_w}{2}\right)^2 - \left(\frac{1}{\kappa} - \frac{ID_w}{2} + OD_t\right)^2},$$

to provide the maximum length of the tool ($L_t$) for given values of the inner diameter of the well ($ID_w$) and the maximum outer diameter of the tool ($OD_t$); and placing the tool in the well at a location before and proximate to a point in the well closest to earth surface where the maximum dimension of the tool calculated is less than size of the tool.

10. The method of claim 9, wherein the measured depth interval used to calculate the dogleg angle is less than 5 meters, and the set length in the converting to the MDLS is greater than 10 meters.

* * * * *